US007500424B2

(12) United States Patent
Gray, Jr. et al.

(10) Patent No.: US 7,500,424 B2
(45) Date of Patent: Mar. 10, 2009

(54) HYDRAULIC MACHINE HAVING PRESSURE EQUALIZATION

(75) Inventors: Charles L. Gray, Jr., Pinckney, MI (US); Matthew J. Brusstar, South Lyon, MI (US)

(73) Assignee: The United States of America as represented by the Administrator of the U.S. Environmental Protection Agency, Washington, DC (US)

( * ) Notice: Subject to any disclaimer, the term of this patent is extended or adjusted under 35 U.S.C. 154(b) by 637 days.

(21) Appl. No.: 10/820,074

(22) Filed: Apr. 7, 2004

(65) Prior Publication Data

US 2005/0226748 A1 Oct. 13, 2005

(51) Int. Cl.
*F01B 13/04* (2006.01)
*F04B 1/12* (2006.01)

(52) U.S. Cl. ..... 91/499; 417/269; 417/521; 417/522

(58) Field of Classification Search ..... 417/269, 417/521, 522; 91/499
See application file for complete search history.

(56) References Cited

U.S. PATENT DOCUMENTS

| | | | | |
|---|---|---|---|---|
| 3,699,845 | A | 10/1972 | Ifield | 91/6.5 |
| 3,956,969 | A | 5/1976 | Hein | 91/6.5 |
| 4,075,933 | A | 2/1978 | Stephens | 91/506 |
| 4,872,394 | A | 10/1989 | Nakagawa et al. | 91/506 |
| 4,893,549 | A | 1/1990 | Forster | 92/12.2 |
| 4,920,856 | A | 5/1990 | Berthold et al. | 91/6.5 |
| 5,086,689 | A | 2/1992 | Masuda | 91/499 |
| 5,105,723 | A | 4/1992 | Kazahaya et al. | 91/485 |
| 5,253,983 | A | 10/1993 | Suzuki et al. | 417/485 |
| 5,572,919 | A | 11/1996 | Ishizaki | 91/499 |
| 5,593,285 | A | 1/1997 | Watts | 417/269 |
| 6,186,748 | B1 | 2/2001 | Umeda et al. | 417/269 |
| 6,406,271 | B1 * | 6/2002 | Valentin | 417/269 |
| 2004/0173089 | A1 | 9/2004 | Gray, Jr. et al. | 91/505 |

FOREIGN PATENT DOCUMENTS

| | | |
|---|---|---|
| EP | 0 389 644 B1 | 7/1994 |
| EP | 0 974 753 A2 | 1/2000 |
| JP | 54-44208 | 7/1979 |

* cited by examiner

*Primary Examiner*—Devon C Kramer
*Assistant Examiner*—Patrick Hamo
(74) *Attorney, Agent, or Firm*—Seed Intellectual Property Law Group, PLLC

(57) ABSTRACT

A hydraulic machine includes a valve plate, with first and second fluid ports in a surface thereof. A cylinder barrel is rotatably coupled to the valve plate. A plurality of cylinders is formed in the cylinder barrel, such that, as the barrel rotates, each cylinder is coupled to the first and second fluid ports, sequentially. First and second pressure relief ports are formed in the surface of the valve plate between the first and second fluid ports at top- and bottom-dead-center, respectively. A cross-port bore is formed in the valve plate, placing the first and second pressure relief ports in fluid communication with each other. As each cylinder rotates to top-dead-center, an opposite cylinder rotates to bottom-dead-center. The respective cylinders are coupled to the first and second pressure relief ports, such that differential pressure in the cylinders is equalized.

15 Claims, 8 Drawing Sheets

HYDRAULIC MACHINE HAVING PRESSURE EQUALIZATION

BACKGROUND OF THE INVENTION

1. Field of the Invention

This disclosure is directed in general to hydraulic pumps and motors, and in particular to hydraulic machines having cylinder barrels rotatably coupled to valve plates.

2. Description of the Related Art

There is a class of hydraulic machines that employs a rotating barrel having a plurality of cylinders, and pistons reciprocating within the cylinders. The barrel is configured to rotate over a valve plate having inlet and outlet ports. The barrel rotates over the valve plate, and fluid passes into, and out of, the cylinders of the barrel. In a hydraulic pump, fluid is drawn into each cylinder from a low pressure inlet port and forced out of the cylinder to a high pressure outlet port. In a hydraulic motor, fluid from a high pressure inlet enters each cylinder in turn and vents to a low pressure outlet. Some machines, commonly referred to as pump/motors, are configured to operate as pumps or motors, according to how fluid is applied to the machine.

FIG. 1A shows a sectional view of a portion of a bent-axis pump/motor 100 according to known art. The pump/motor 100 includes a valve plate 102 and a cylinder barrel 104, having a plurality of cylinders 106, within which pistons 108 travel reciprocally. The pistons 108 each have a sliding seal engagement with walls of the respective cylinder 106, at first ends of the pistons. Each of the pistons 108 engages a respective socket formed in a thrust plate 110 at a second end thereof. Typically, bent-axis pump/motors are provided with an odd number of cylinders and pistons, usually seven or nine. In FIGS. 1A-1C cylinders 106 and pistons 108 are shown positioned at both the top and bottom of the barrel 104 simultaneously (which would not be the case in an actual machine employing an odd number of cylinders) for the purpose of illustrating the relative volumes of fluid constrained by the pistons 108 at the top and bottom of rotation.

The cylinder barrel 104 is configured to rotate around a first axis A with a face 114 of the cylinder barrel 104 slideably coupled to a face 116 of the valve plate 102. The thrust plate 110 rotates around an axis B, and is coupled to the rotating cylinder barrel 104 by a constant velocity joint, which is well known in the art, and is not shown in FIG. 1. Accordingly, the cylinder barrel 104 and the thrust plate 110 rotate at a common rate. The axis A is rotatable with reference to the axis B for the purpose of varying the displacement volume of the pump/motor 100. FIG. 1A shows the pump/motor 100 positioned at a moderate stroke angle. FIG. 1B shows the pump/motor 100 at a stroke angle of zero, wherein the axes A and B are coaxial, and wherein energy transfer is virtually zero. FIG. 1C shows the pump/motor 100 at a maximum stroke angle, which provides a maximum displacement of the pump/motor for a high degree of energy transfer.

As the cylinder barrel 104 rotates, each of the cylinders 106 follows a circular path. The uppermost point of that path is referred to as top-dead-center, indicated in FIGS. 1A-1C as TDC, while the lowermost point in the rotation is referred to as bottom-dead-center, indicated in FIGS. 1A-1C as BDC.

Referring to FIGS. 1B and 1C, it may be seen that when the pump/motor is at a minimum stroke angle, as shown in FIG. 1B, the fluid volume within the cylinders 106 at top-dead-center and bottom-dead-center is approximately equal. On the other hand, when the stroke angle is at a maximum, as shown in FIG. 1C, the volume of fluid within the cylinder 106 at bottom-dead-center is at a maximum, while the volume of fluid within the cylinder 106 at top-dead-center is at a minimum.

FIG. 2 shows the cylinder barrel 104 in a view indicated at lines 2-2 of FIG. 1A, the barrel face 114 being shown in plan view. A cylinder port 112 provides fluid communication from each of the cylinders 106 to the barrel face 114. The position of the cylinder 106 corresponding to each of the cylinder ports is shown in hidden lines.

FIG. 3 shows the valve plate 102 as seen from lines 3-3 of FIG. 1A, the surface 116 of the valve plate 102 being shown in plan view. TDC and BDC are also shown in FIG. 3, indicating the highest point of rotation, and lowest point of rotation, respectively.

Kidney ports 118, 119 are arranged respectively to the left and right of top-dead-center and bottom-dead-center of the valve plate 102. The kidney ports 118, 119 are configured to be differentially pressurized by high and low pressure fluid sources. As the cylinder barrel 104 rotates over the valve plate 102, each of the cylinder ports 112, shown in phantom lines in FIG. 3, is placed in fluid communication, alternately, with the kidney ports 118, 119.

The operation of the pump/motor 100, described with reference to FIGS. 1A-3, is well known in the art, and so will not be described in detail here. A more detailed description of the operation of a bent-axis pump/motor is described in U.S. patent application Ser. No. 10/379,992, which is incorporated herein by reference, in its entirety.

A problem common to many hydraulic machines incorporating features similar to those described herein occurs as each cylinder port traverses from contact with a first kidney port pressurized at a first pressure, to a second kidney port pressurized at a second pressure. For example, in a case where the pump/motor 100 is functioning as a motor, and wherein the kidney port 118 is pressurized at a high pressure, while the kidney port 119 is pressurized at a low pressure, the cylinder barrel 104 will rotate over the valve plate 102 in a counterclockwise direction R, as viewed in FIG. 3.

As each cylinder port 112 rotates over the kidney port 118 at the end closest to top-dead-center, pressurized fluid from the kidney port 118 will enter the cylinder 106 via the cylinder port 112. The pressurized fluid will drive the piston 108 outward in the cylinder 106, against the thrust plate 110, causing the barrel 104 and thrust plate 110 to rotate in the counterclockwise direction. As each piston 106 leaves the high pressure kidney port 118 at the end closest to the bottom-dead-center of the device, fluid within the cylinder 106 is maintained at the pressure of the high pressure fluid source coupled to the kidney port 118. At the moment that the cylinder port 112 begins to cross over onto the kidney port 119 at its end closest to the bottom-dead-center, a sudden drop in fluid pressure is realized within the cylinder 106, as the pressure within the cylinder is vented to the kidney port 119, which is pressurized at a low pressure. This sudden venting causes a pressure pulse in the pump/motor 100. A second pressure pulse occurs at the top of the cycle, as each of the cylinders 106, pressurized at the low pressure of the kidney port 119, begins to cross onto the kidney port 118 near top-dead-center, at which point each cylinder 106 is suddenly pressurized at the high pressure of kidney port 118.

Because most hydraulic machines are manufactured with an odd number of cylinders, the pressurizing pulses at the leading edge of the kidney port 118 and the depressurizing pulses at the leading edge of kidney port 119 occur alternately, with one pressurizing pulse and one depressurizing pulse occurring for each cylinder in each cycle of rotation. Accordingly, in a hydraulic machine such as pump/motor

100, having seven cylinders, there will be fourteen high energy pressure pulses per revolution. These pressure pulses are experienced as vibration in the pump/motor 100, as well as noise at a pitch corresponding to the frequency of pressure pulses.

Additionally, in known systems, when a cylinder port crosses into fluid communication with one of the kidney ports, there is an energy cost associated with bringing the corresponding cylinder to the pressure of the respective kidney port. For example, with reference to FIG. 3, as cylinder port 112*a* crosses the threshold of kidney port 118, the low pressure within the corresponding cylinder is brought up to the high pressure of the kidney port 118, which requires energy. On the other hand, as a cylinder port crosses bottom-dead-center and crosses over the threshold of the kidney port 119, the energy represented by the pressure within the corresponding cylinder is lost as that pressure is vented into the low pressure kidney port 119.

There are many known methods for reducing or smoothing the pressure pulses that occur as each cylinder transitions from one pressure to another. However, in each of these cases the energy losses described above still occur. One such scheme is described with reference to U.S. Pat. No. 6,186,748, issued to Umeda et al., which is incorporated herein by reference, in its entirety.

BRIEF SUMMARY OF THE INVENTION

According to an embodiment of the invention, a hydraulic machine is provided, including a valve plate, with first and second kidney ports formed on a surface of the valve plate. A cylinder barrel, having a barrel face, is rotatably coupled to the valve plate such that the barrel face is in face to face contact with the surface of the valve plate. A plurality of cylinders are formed in the cylinder barrel, each having a cylinder port formed in the barrel face such that as the barrel rotates, each cylinder port is coupled to the first and second kidney ports, sequentially, each cylinder port being in fluid contact with its respective cylinder. A first pressure relief port is formed in the surface of the valve plate such that, as each of the cylinder ports reaches a top-dead-center of rotation, the respective cylinder port is coupled to the first pressure relief port, and a second pressure relief port is formed in the surface of the valve plate such that, as each of the cylinder ports reaches a bottom-dead-center of rotation, the respective cylinder port is coupled to the second pressure relief port.

In accordance with an embodiment of the present invention, a cross-port bore is formed in the valve plate and configured to place the first and second pressure relief ports in fluid communication with each other, such that, as pairs of cylinder ports directly opposite one another rotate into fluid communication with the first and second pressure relief ports, respectively, differential pressure in each pair of cylinders is equalized.

Each of the plurality of cylinder ports may include a vent notch positioned such that when the respective cylinder port is at the top-dead-center or bottom-dead-center of rotation, the vent notch is coupled to the first or second pressure relief port, respectively. Alternatively, the cylinder barrel may include a plurality of vent apertures formed in the barrel face, each aperture being in fluid communication with a respective one of the plurality of cylinder ports, and positioned in the barrel face such that when each cylinder port is at the top-dead-center or bottom-dead-center of rotation, the respective vent aperture is coupled to the first or second pressure relief port, respectively.

Advantages of the principles of the invention include improved efficiency and reduced noise and vibration.

BRIEF DESCRIPTION OF THE SEVERAL VIEWS OF THE DRAWING(S)

DETAILED DESCRIPTION OF THE INVENTION

Figure 4:
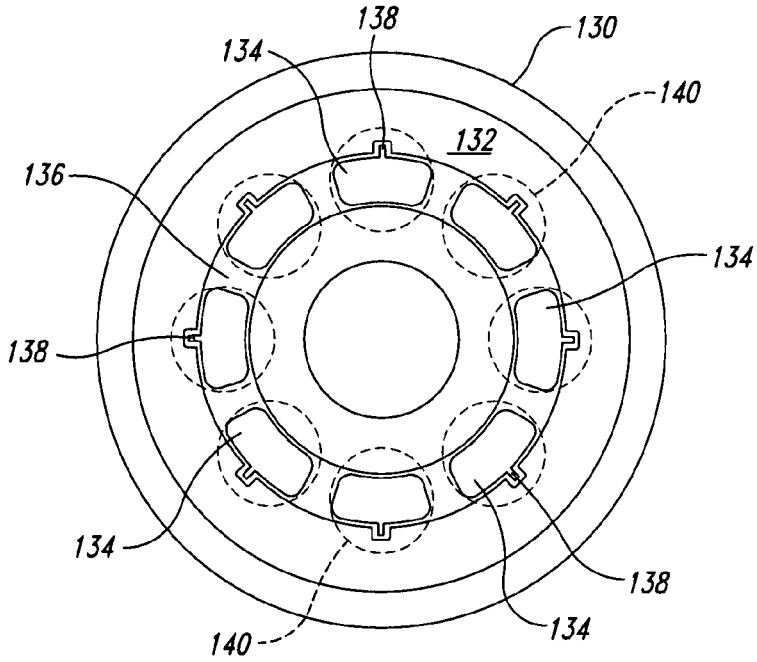
FIG. 4 shows a cylinder barrel face of a pump/motor in plan view, according to an embodiment of the invention.

An embodiment of the invention will now be described with reference to FIGS. 4-6. FIG. 4 shows a cylinder barrel 130 of a pump/motor with a barrel face 132 visible in plan view. The barrel 130 includes an even number of cylinders 140, each shown in hidden lines. The cylinders 140 are in fluid communication with the barrel face 132 via cylinder ports 134. Each of the cylinder ports 134 includes a vent notch 138 positioned on a perimeter of the respective cylinder port 134. A sealing land 136 is provided to slideably mate with a face of a valve plate.

Figure 5:
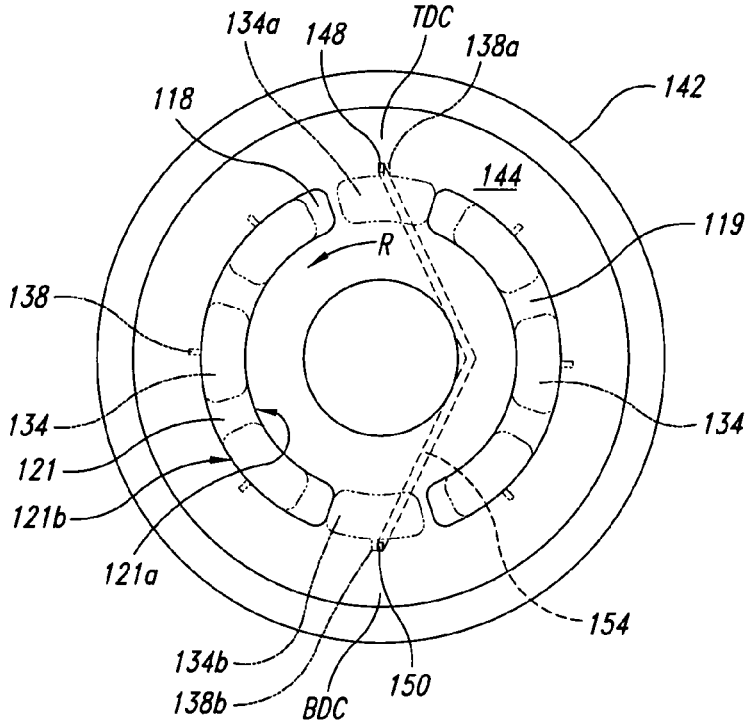
FIG. 5 shows a valve plate face of the pump/motor of FIG. 4, in plan view.

FIG. 5 shows a face 144 of a valve plate 142, in plan view. The valve plate 142 includes kidney ports 118, 119 positioned to the right and left of top-dead-center and bottom-dead-center, in a known manner. Each of the kidney ports 118, 119 has a shape that describes a portion of a circle, and is positioned in the valve plate 142 such that the kidney ports define inner and outer circumferences 121*a*, 121*b* of an annular region 121 of the valve plate 142. The valve plate 142 also includes first and second pressure relief ports 148, 150 positioned at top-dead-center and bottom-dead-center, respectively, and substantially outside of the annular region 121 defined by the inner and outer circumferences 121*a*, 121*b*. In the embodiment illustrated in FIG. 5, the pressure relief ports 148, 150 are positioned, radially, outside the outer circumference 121*b*. The first and second pressure relief ports 148, 150 are in fluid communication with each other via a pressure relief channel or bore 154, shown in hidden lines in FIG. 5.

When the cylinder barrel 130 is positioned on the valve plate 142, such that the barrel face 132 is in face-to-face contact with the valve plate face 144, the cylinder ports 134 are slideably coupled to the valve plate face 144 as shown in phantom lines in FIG. 5.

Figure 6:
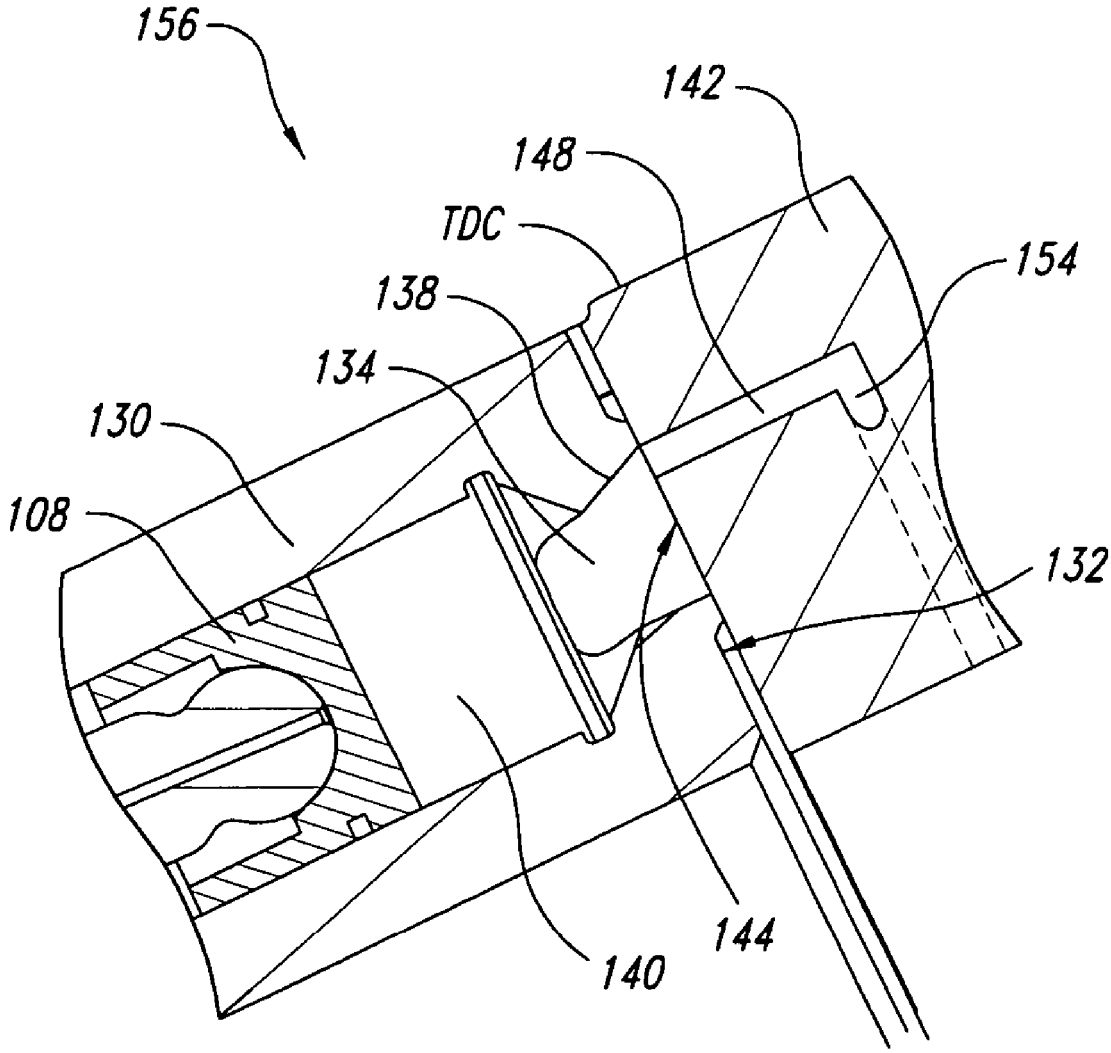
FIG. 6 shows a sectional view of a detail of the pump/motor of FIG. 4.

Referring now to FIG. 6, a sectional detail of a pump/motor 156 is shown, with the section taken along a line between top-dead-center and bottom-dead-center of the valve plate 142, with the cylinder barrel 130 in a point of its rotation such that one of the cylinders 140 is positioned precisely at top-dead-center. The detail of FIG. 6 also shows a piston 108 positioned within the cylinder 140. It may be seen that, with the cylinder 140 at top-dead-center, the vent notch 138 is in fluid communication with the pressure relief port 148.

Operation of the pump/motor 156 will now be described with reference, in particular, to FIG. 5. For the purpose of this description, it will be assumed that the pump/motor 156 is operating as a motor, and that the kidney port 118 is in fluid communication with a high pressure fluid source, while the kidney port 119 is in fluid communication with a low pressure fluid source. Given this configuration, the cylinder barrel 130 will be compelled to rotate in a counterclockwise direction R, with reference to FIG. 5.

The cylinder ports 134 are shown in phantom lines, positioned in contact with the face 144 of the valve plate 142. In particular, cylinder port 134*a* is shown at a point of rotation where fluid communication with the kidney port 119 has just terminated. It will be understood that at this point the cylinder associated with cylinder port 134*a* is pressurized at the low pressure of the low pressure fluid source coupled to the kidney port 119. It will also be understood that as the cylinder port 134*a* approaches top-dead-center, the associated piston 108 is approaching its point of greatest penetration within the cylinder 140.

In the position shown, the vent notch 138*a* is on the verge of coming into fluid communication with the pressure relief port 148. Directly opposite the cylinder port 134*a*, the cylinder port 134*b* is at the point in the rotation where it is just losing fluid communication with kidney port 118, and the vent notch 138*b* is on the verge of coming into fluid communication with pressure relief port 150. It will also be understood that at this point in rotation, the cylinder associated with cylinder port 134*b* is pressurized at the high fluid pressure associated with the high pressure fluid source coupled to the kidney port 118, and that as the cylinder port 134*b* approaches bottom-dead-center the associated piston 108 is at its point of maximum withdrawal from the corresponding cylinder 140. It can be seen, with reference to FIG. 5, that the leading edges of cylinder ports 134*a*, 134*b* have, respectively, crossed the top- and bottom-dead-center points of rotation before the vent notches 138*a*, 138*b* approach the respective pressure relief ports 148, 150.

As the cylinder barrel 130 continues to rotate over the valve plate 142, the vent notches 138*a*, 138*b* simultaneously come into fluid communication with the pressure relief ports 148, 150, respectively. As this occurs, a portion of the pressure within the cylinder corresponding to the cylinder port 134*b* is transferred via the pressure relief channel 154 to the cylinder 140 corresponding to the cylinder port 134*a*. Because the pistons 108 corresponding to these respective cylinders are at the extremes of travel, there is very little fluid transfer between the pressure relief ports 150 and 148, and their corresponding cylinders. Accordingly, the pressure relief ports 148, 150 and the pressure relief channel 154 connecting the respective cylinders can be limited in capacity.

As the cylinder barrel 130 rotates, the pressure within the cylinders corresponding to cylinder ports 134*a*, 134*b* equalizes to a pressure level somewhere between the high pressure present at the kidney port 118 and the low pressure present at kidney port 119. The actual equalized pressure will depend upon the volume of fluid within the respective cylinders and cylinder ports, which will be discussed in more detail later.

As the cylinder barrel continues to rotate, cylinder port 134*a* reaches a point where the vent notch 138*a* loses fluid communication with the pressure relief port 148, and at this point the leading edge of cylinder port 134*a* verges on coming into fluid communication with kidney port 118. Simultaneously, cylinder port 134*b* arrives at a point in rotation where vent notch 138*b* loses fluid communication with pressure relief port 150, and at the same moment verges on coming into fluid communication with kidney port 119. As the cylinder barrel 130 continues to rotate, cylinder ports 134*a*, 134*b* come into fluid communication with kidney ports 118, 119, respectively. At this point, pressure within the cylinder 140 associated with cylinder port 134*a* rises to the full pressure of the high pressure fluid source coupled to the kidney port 118, while the fluid pressure within the cylinder associated with cylinder port 134*b* drops to the pressure of the low pressure fluid source associated with the kidney port 119.

Figure 1A:
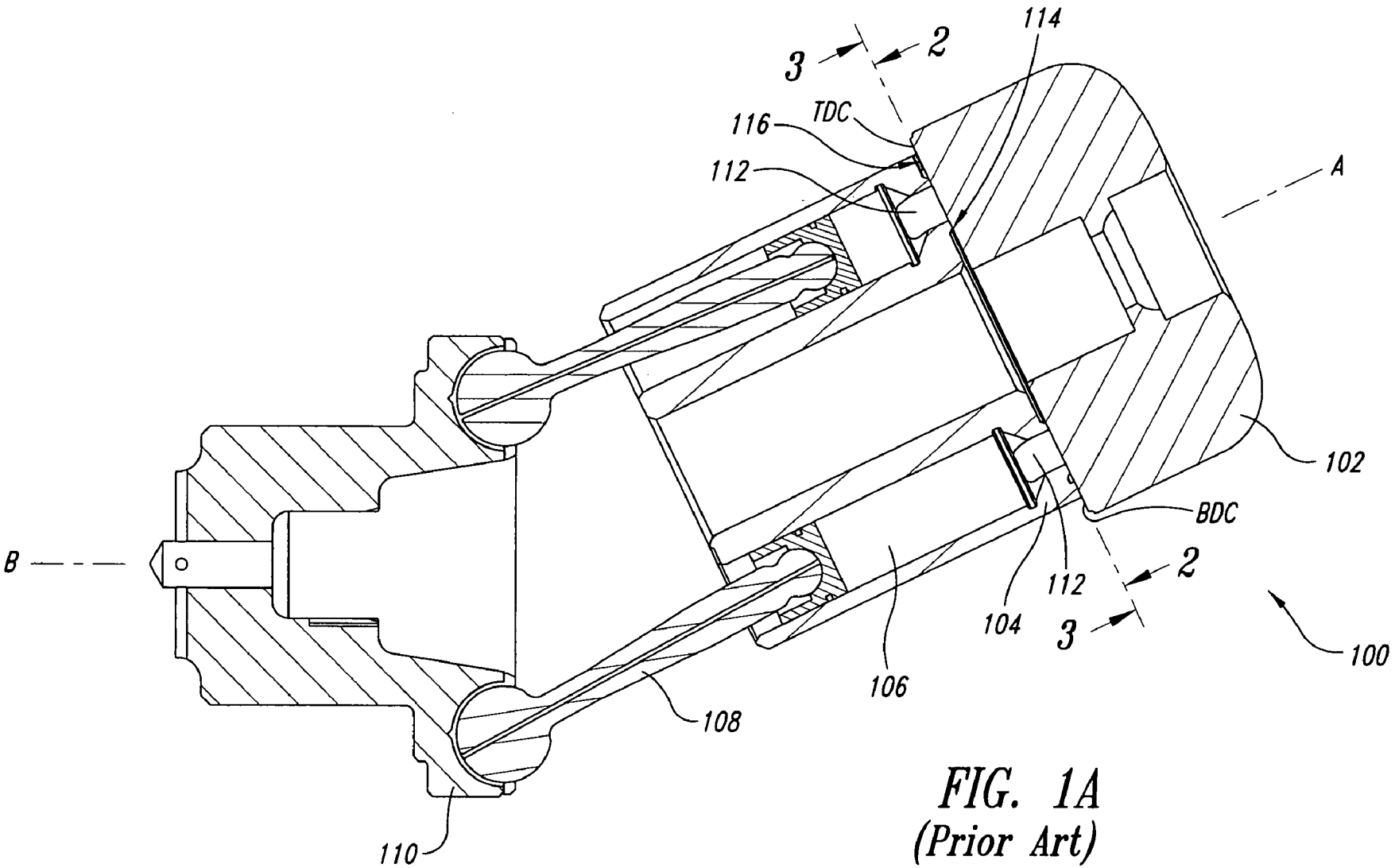
FIG. 1A (Prior Art)
FIG. 1A shows a sectional view of a portion of a pump/motor, according to known art.
Figure 1B:
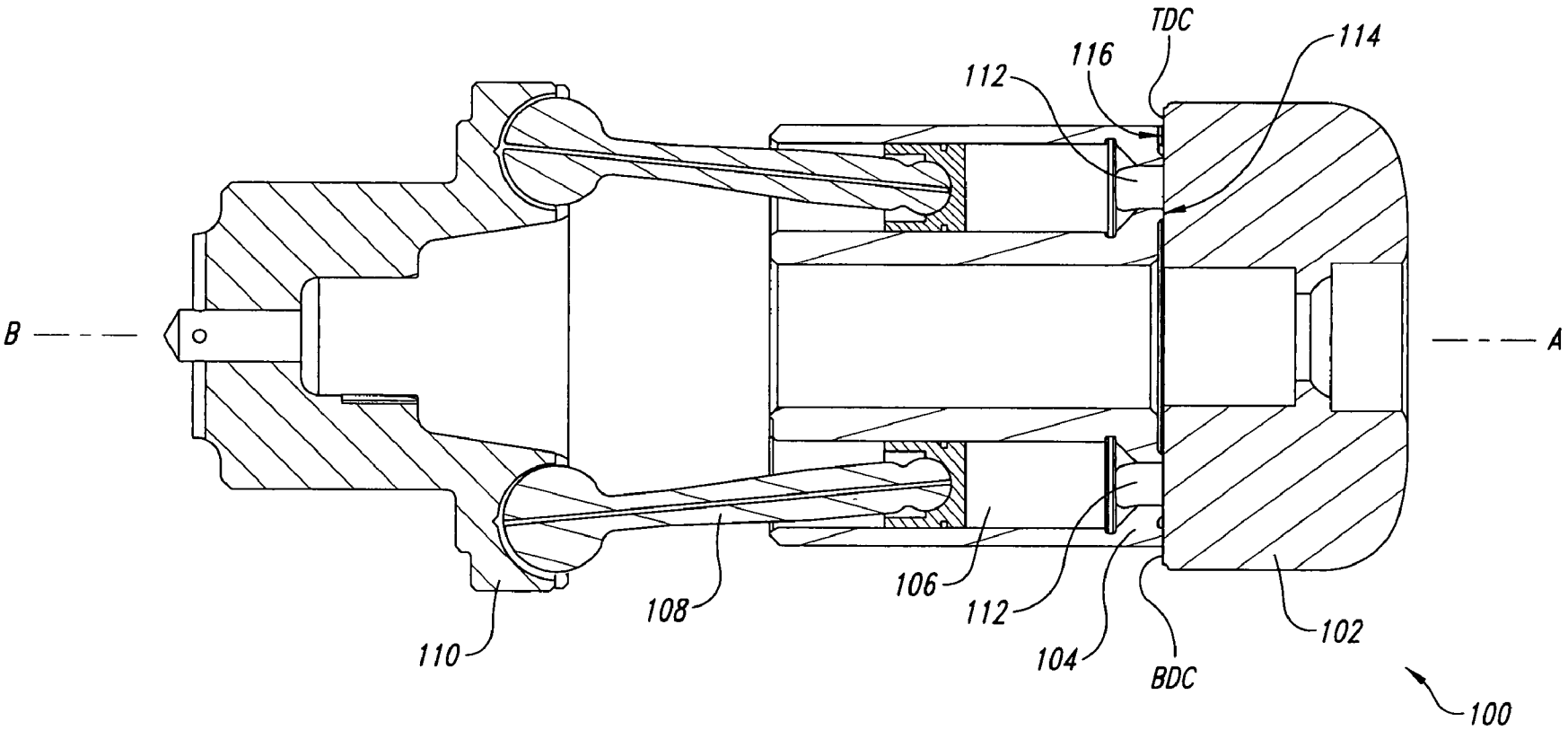
FIG. 1B (Prior Art)
FIG. 1B shows the pump/motor of FIG. 1A at a zero stroke angle.
Figure 1C:
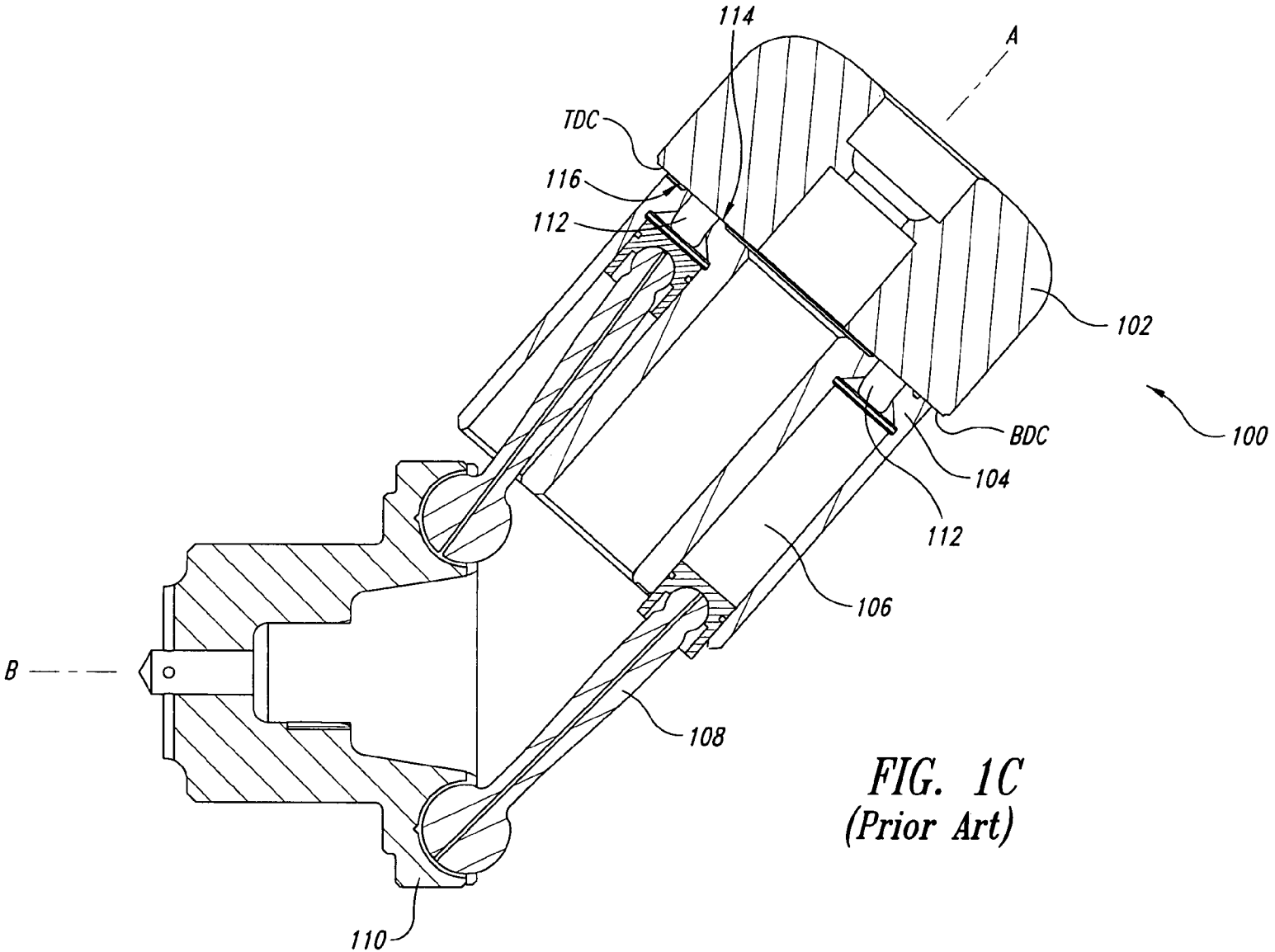
FIG. 1C (Prior Art)
FIG. 1C shows the pump/motor of FIG. 1A at a maximum stroke angle.
Figure 2:
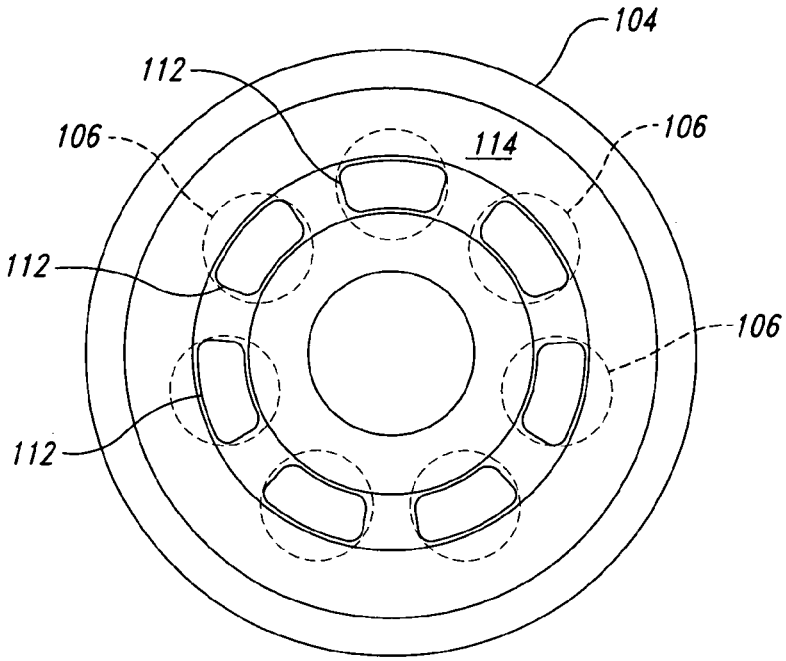
FIG. 2 (Prior Art)
FIG. 2 shows a cylinder barrel face of a pump/motor in plan view, according to known art.
Figure 3:
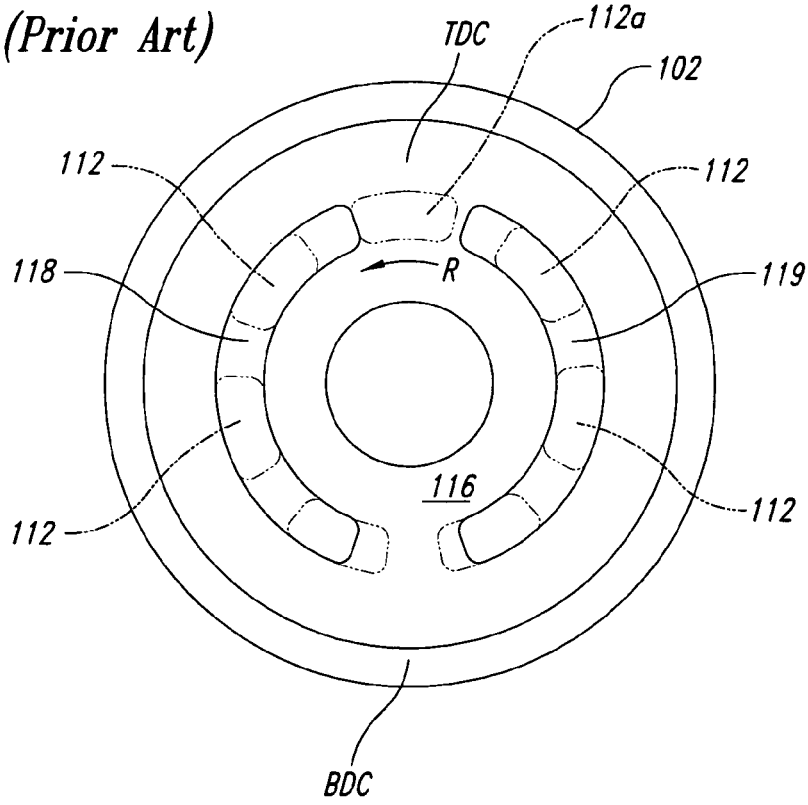
FIG. 3 (Prior Art)
FIG. 3 shows a valve plate face of a pump/motor in plan view, according to known art.

It will be recognized however, that, in contrast to the system described with reference to FIGS. 1-3, the fluid pressures within the cylinders 140 corresponding to cylinder ports 134*a*, 134*b* are already equalized. Accordingly, the associated pressure pulses are of a much lower magnitude than those of previously known systems.

When unequal pressure is equalized between cylinders having unequal volumes of fluid, the pressure value of the resulting equalized pressure will be dominated by the cylinder having the larger volume of fluid. Thus, in a pump/motor positioned at a minimum stroke angle, in which the cylinders being equalized are of approximately the same volume, the resulting equalized pressure will be an average of the pressures in each of the cylinders. On the other hand, as the stroke angle increases, the cylinder at bottom-dead-center will have more and more fluid volume, while the cylinder at top-dead-center will have progressively less fluid volume. As the stroke angle increases, the equalized pressure will be closer and closer to that of the larger fluid volume, at bottom-dead-center. In a hypothetical case in which there is a fluid volume of zero in the cylinder at top-dead-center, the equalized pressure would be substantially equal to that of the fluid in the cylinder at bottom-dead-center.

In contrast to previously known systems, the cross-port equalization of the present invention provides for a portion of the energy represented by the pressure in the higher pressure cylinder to be transferred to the lower pressure cylinder. Thus, there is an energy savings associated with the principles of the present invention. This energy savings is greatest at low stroke angles, when the volumes of the cylinders at top-dead-center and bottom-dead-center are closest to equal, and diminishes as the stroke angle increases. Nevertheless, even at maximum stroke angle there is a measurable improvement in energy efficiency over known systems.

Another advantage provided by some embodiments of the invention, over known art, is in the realm of noise and vibration. As was previously explained, there is a pressure pulse associated with the transition of each cylinder from one pressure to another. This transition occurs twice per revolution for each cylinder. Accordingly, in commonly known systems, which employ odd numbers of cylinders, the number of pulses per revolution will be equal to twice the number of cylinders. According to an embodiment of the invention, an even number of cylinders is provided in the cylinder barrel. For this reason, there is always a cylinder transitioning from high to low pressure simultaneously with another cylinder transitioning from low to high. Thus, the transition pulses occur simultaneously, thereby reducing the number of pulses per revolution in half, and reducing the pitch of the audible noise by about one octave.

Referring to FIG. 5, the pressure pulse begins at a point in the revolution of the cylinder barrel just beyond the position shown in FIG. 5, as the vent notches 138*a*, 138*b* pass the thresholds of the pressure relief ports 148 and 150, respectively. The pulse continues as the vent notches 138*a*, 138*b* lose fluid communication with the respective pressure relief ports 148, 150, and simultaneously cross the threshold of the respective kidney ports 118, 119, where the pulse ends when the pressure within the respective cylinders is fully equalized with the pressure in the respective kidney ports. Thus, according to the principles of the invention, the pulse frequency is lower, while the length of the pulse is extended, thereby reducing the strength or sharpness of the pulse. In this way, vibration is reduced in the pump/motor and the frequency of the noise produced is significantly lower, and thereby less offensive.

Figure 7:
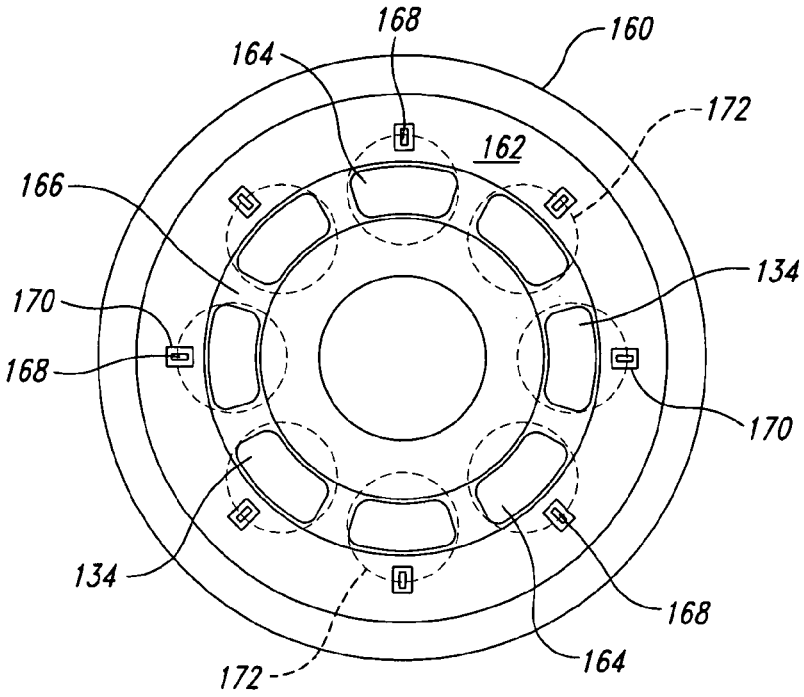
FIG. 7 shows a cylinder barrel face of a pump/motor in plan view, according to another embodiment of the invention.
Figure 8:
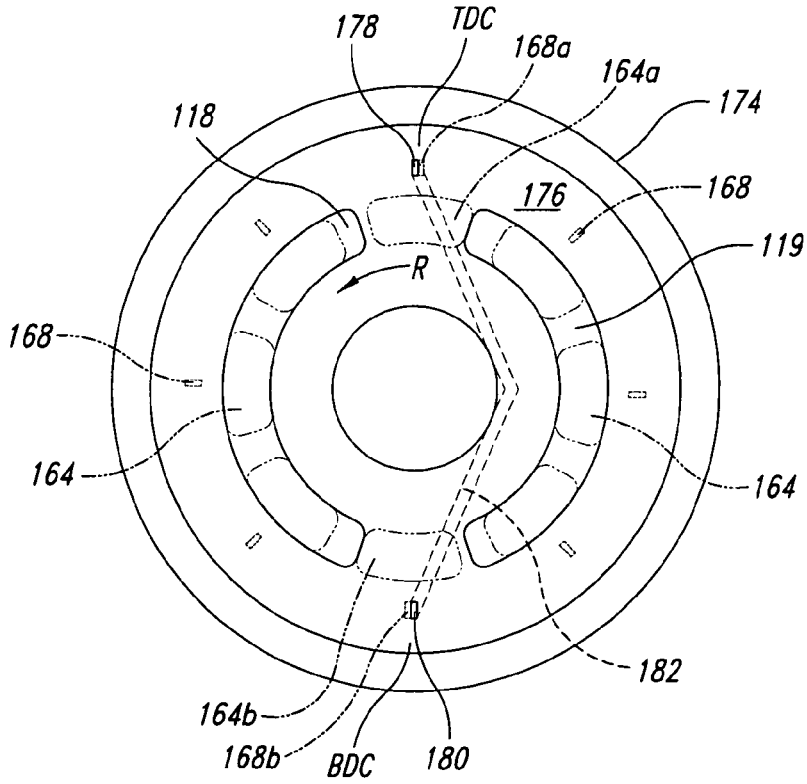
FIG. 8 shows a valve plate face of the pump/motor of FIG. 7, in plan view.
Figure 9:
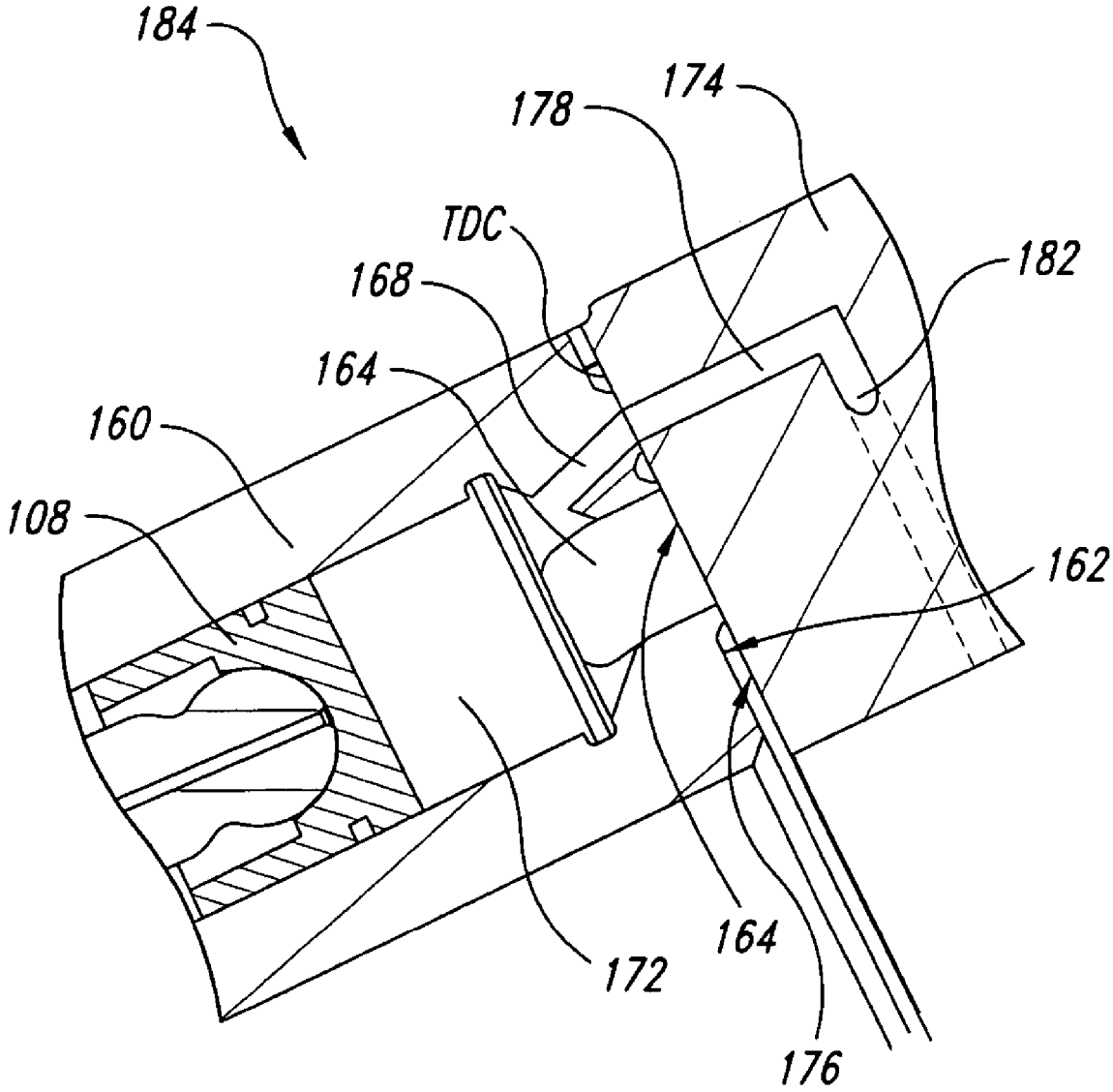
FIG. 9 shows a sectional view of a detail of the pump/motor of FIG. 7.

Referring now to FIGS. 7-9, another embodiment of the invention is described. FIG. 7 shows, in plan view, a face 162 of a cylinder barrel 160. The cylinder barrel 160 includes cylinder ports 164, each in fluid communication with a respective cylinder 172. A sealing land 166 is provided to slideably mate with a face 176 of a valve plate 174, as shown in FIG. 8. In addition, a plurality of vent apertures 168 is formed in the cylinder barrel 160, each in fluid communication with a respective cylinder 172, as may be seen in cross-section in FIG. 9. Each of the vent apertures 168 is also provided with a sealing land 170 to effectively seal against the valve plate face 176.

FIG. 8 shows the face 176 of valve plate 174, in plan view. The cylinder ports 164 are shown in phantom lines as they are positioned when the cylinder block 160 is in face-to-face contact with the valve plate 174. The cylinder ports 164 and the vent apertures 168 are shown at a point in the rotation where cylinder ports 164*a*, 164*b* have just lost fluid communication with kidney ports 119, 118, respectively, and vent apertures 168*a*, 168*b* are at the threshold of coming into fluid communication with pressure relief ports 178, 180. FIG. 8 also shows, in hidden lines, a pressure relief channel 182, which is configured to place the pressure relief ports 178, 180 in fluid communication with each other.

FIG. 9 shows a detail of a pump/motor 184, in which one of the cylinders 172 is at top-dead-center, with a piston 108 shown in the cylinder as well. The vent aperture 168 may be seen providing a fluid channel between the cylinder 172 and the pressure relief port 178, at top-dead-center. The pressure relief channel 182 is shown, coupled to the pressure relief port 178.

In operation, the pump/motor 184 functions in a manner similar to pump/motor 156, wherein the pressure relief ports 178, 180 and pressure relief channel 182 are configured to equalize pressure between opposing pairs of cylinders 172 as they reach top-dead-center and bottom-dead-center, respectively.

While various embodiments of the invention have been described, with reference to the attached figures, other hydraulic machines, not described herein, may also practice the principles of the invention, and are considered to fall within the scope of the invention. For example, the invention has been described with reference to a bent-axis pump/motor. Swash plate pump/motors are also known to employ a rotating cylinder barrel over a valve plate, in a manner similar to that described with reference to embodiments of the invention disclosed herein, and are considered to fall within the scope of the invention. Other embodiments of the invention include hydraulic machines configured to function solely as pumps or motors, as well as machines having fixed displacement, and reversible displacement. The principles of the invention may also be combined with other schemes for reducing pump/motor noise and vibration, or for improving efficiency, without departing from the scope of the invention.

All of the above U.S. patents, U.S. patent application publications, U.S. patent applications, foreign patents, foreign patent applications and non-patent publications referred to in this specification and/or listed in the Application Data Sheet, are incorporated herein by reference, in their entirety.

From the foregoing it will be appreciated that, although specific embodiments of the invention have been described herein for purposes of illustration, various modifications may be made without deviating from the spirit and scope of the invention. Accordingly, the invention is not limited except as by the appended claims.

The invention claimed is:

1. A valve plate for a hydraulic machine, comprising:

first and second ports, each having a shape that describes a portion of a circle, formed in the valve plate and positioned such that the first and second ports define inner and outer circumferences of an annular region of the valve plate;

a first pressure relief port located in the valve plate substantially outside of the annular region at a top-dead-center position; and a second pressure relief port located in the valve plate substantially outside of the annular region at a bottom-dead-center position, the second pressure relief port being in fluid communication with the first pressure relief port.

2. The valve plate of claim 1 wherein the first and second ports are configured to be selectively coupled to high- and low-pressure fluid sources or low- and high-pressure fluid sources respectively.

3. A hydraulic machine, comprising:

a valve plate;

first and second kidney ports provided in a surface of the valve plate;

a cylinder barrel having a barrel face, the cylinder barrel being rotatably coupled to the valve plate such that the barrel face is in face to face contact with the surface of the valve plate;

an even numbered plurality of cylinders formed in the cylinder barrel;

a plurality of cylinder ports formed in the barrel face of the cylinder barrel such that as the barrel rotates, each cylinder port is coupled to the first and second kidney ports, sequentially, each cylinder port being in fluid contact with respective cylinders of the cylinder barrel;

a first pressure relief port formed in the surface of the valve plate such that, as each of the cylinder ports reaches a top-dead-center of rotation, the respective cylinder port is coupled to the first pressure relief port;

a second pressure relief port formed in the surface of the valve plate such that, as each of the cylinder ports reaches a bottom-dead-center of rotation, the respective cylinder port is coupled to the second pressure relief port, the first and second pressure relief ports and each of the plurality of cylinder ports being shaped and positioned such that, during rotation of the cylinder barrel, each cylinder port partially crosses top- or bottom-dead-center before being coupled to the respective pressure relief port; and a bore extending between the first and second pressure relief ports to place the first and second pressure relief ports in fluid communication with each other.

4. The machine of claim 3 wherein each of the plurality of cylinder ports includes a vent notch positioned such that when the respective cylinder port is at the top-dead-center or bottom-dead-center of rotation, the vent notch is coupled to the first or second pressure relief port, respectively.

5. The machine of claim 4 wherein the valve plate and cylinder barrel are configured such that, as the cylinder barrel rotates over the valve plate, each cylinder port, in turn, breaks fluid communication with the first kidney port and enters fluid communication with the first pressure relief port substantially simultaneously, while an opposing cylinder port breaks fluid communication with the second kidney port and enters fluid communication with the second pressure relief port, also substantially simultaneously.

6. The machine of claim 3, further comprising a plurality of vent apertures formed in the barrel face, each aperture being in fluid communication with a respective one of the plurality of cylinder ports and positioned in the barrel face such that when each cylinder port is at the top-dead-center or bottom-dead-center of rotation, the respective vent aperture is coupled to the first or second pressure relief port, respectively.

7. The machine of claim 3, further comprising:

a plurality of pistons, each having a first end positioned within a respective one of the plurality of cylinders; and a thrust plate having a plurality of sockets, and wherein a second end of each of the plurality of pistons is positioned in a respective one of the plurality of sockets.

8. The machine of claim 7, further comprising:

a first axis, around which the cylinder barrel is configured to rotate; and a second axis, around which the thrust plate is configured to rotate, the first and second axes being configured to rotate in a plane around a common point, with respect to each other.

9. A hydraulic machine, comprising:

a valve plate having a valve surface, and further having first and second fluid ports configured to be coupled to first and second pressurized fluid sources;

a cylinder barrel rotatably coupled to the valve plate over the valve surface, the barrel having a plurality of cylinders formed in a circular arrangement in the barrel, each cylinder having a cylinder port configured to be in fluid contact, alternately, with the first and second fluid ports as the barrel rotates thereover; and means for equalizing fluid pressure in pairs of the plurality of cylinders on opposite sides of the circular arrangement, beginning only after the cylinder ports of each pair of cylinders begin to cross top-dead-center and bottom-dead-center of rotation, respectively.

10. The hydraulic machine of claim 9 wherein the number of cylinders is an even number.

11. A method, comprising:

rotating a barrel of a hydraulic machine, the barrel having a plurality of cylinders formed therein, each having a respective cylinder port; and placing a first cylinder, after its respective cylinder port begins to cross top-dead-center of rotation, in fluid communication with a second cylinder, after its respective cylinder port begins to cross bottom-dead-center of rotation.

12. The method of claim 11, further comprising:

further rotating the barrel until third and fourth cylinders reach top- and bottom-dead-center of rotation, respectively; and placing the third and fourth cylinders in fluid communication with each other.

13. The method of claim 11, further comprising:

placing the first cylinder in fluid communication with a first fluid port of a valve plate while placing the second cylinder in fluid communication with a second fluid port of the valve plate; and breaking fluid communication between the first cylinder port and the first fluid port while breaking fluid communication between the second cylinder port and the second fluid port.

14. The method of claim 13 wherein the placing the first and second cylinders in fluid communication step, and the breaking fluid communication step are performed substantially simultaneously.

15. The method of claim 11 wherein the placing the first and second cylinders in fluid communication comprises equalizing pressures of the first and second cylinders to a pressure that is higher than a pressure of a low-pressure fluid supply of the hydraulic machine and lower than a pressure of a high-pressure fluid supply of the machine.

* * * * *